United States Patent [19]

Helling et al.

[11] 4,353,972

[45] Oct. 12, 1982

[54] LIGHT-SENSITIVE PHOTOGRAPHIC MATERIAL COMPRISING POLYMERIC MORDANT LAYER

[75] Inventors: Günter Helling, Cologne; Kaspar Wingender; Wolfgang Himmelmann, both of Leverkusen; Manfred Beck, Odenthal, all of Fed. Rep. of Germany

[73] Assignee: AGFA-Gevaert AG, Leverkusen, Fed. Rep. of Germany

[21] Appl. No.: 196,632

[22] Filed: Oct. 14, 1980

[30] Foreign Application Priority Data

Oct. 16, 1979 [DE] Fed. Rep. of Germany ..... 2941818

[51] Int. Cl.[3] ..... G03C 1/04

[52] U.S. Cl. ..... 430/213; 430/371; 430/518

[58] Field of Search ..... 430/213, 371, 518

[56] References Cited

U.S. PATENT DOCUMENTS 3,709,690 1/1973 Cohen et al. ..... 430/213

FOREIGN PATENT DOCUMENTS 2551786 5/1976 Fed. Rep. of Germany .

*Primary Examiner*—John D. Welsh

*Attorney, Agent, or Firm*—Connolly and Hutz

[57] ABSTRACT

As mordant for mordanting diffusing anionic dyes in image receiving layers of photographic dye diffusion materials the invention makes use of addition polymers having at least 10 mole % of recurring structural units of formula I

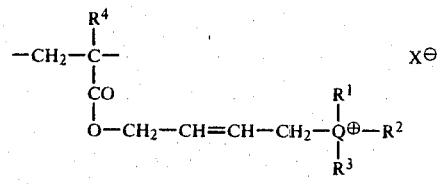

I in which

Q represents nitrogen or phosphorus;

$R^1$, $R^2$, $R^3$ each represents a carbocyclic or alkyl group or two of these substituents complete a 5- or 6-membered heterocyclic ring $R^4$ represents hydrogen or alkyl, $X^{\ominus}$ is an anion.

6 Claims, No Drawings

LIGHT-SENSITIVE PHOTOGRAPHIC MATERIAL COMPRISING POLYMERIC MORDANT LAYER

The invention relates to a photographic material comprising a substrate and at least one layer which is applied thereon, which contains a polymeric mordant for acidic dyes.

It is known to use polymeric mordants for acidic dyes in photographic layers. In this manner, either diffusible, acidic dyes can be fixed (in the image-receiving layer) or the diffusion resistance of acidic dyes and also other photographically active compounds, which may have only a slight tendency towards diffusion, can be further improved. The term "photographic layers" can hereby be understood to refer quite generally to light-sensitive layers, e.g. silver halide emulsion layers, and also non-light-sensitive layers, e.g. adhesive layers, intermediate layer, filter layers, antihalation layers and protective layers.

In order to carry out the dye diffusion transfer process, a light-sensitive material is usually used, which contains color-providing compounds in or adjacent to at least one silver halide emulsion layer and an image-receiving material, substantially consisting of an image-receiving layer coated on a substrate, in which image-receiving layer the required color image is produced by diffusible dyes being imagewise transferred. For this purpose, it is necessary to establish a firm contact between the light-sensitive material and the image-receiving layer during at least a finite period of time within the development time, so that the imagewise distribution of diffusible dyes which is produced in the light-sensitive material as a result of development can be transferred onto the image-receiving layer. The contact can be made after development has commenced or it can be made before development commences. The latter is the case if for example, an integral recording material is used, in which the light-sensitive material and the image-receiving material form an integral unit. Embodiments of the dye diffusion transfer process are known, in which an integral unit of this type still exists even after the development process has finished; i.e. no provision is made for separating the light-sensitive material from the image-receiving material even after color transfer has taken place. An embodiment of this type is described for example in German Offenlegungsschrift No. 2,019,430. However, according to another embodiment, the image-receiving material which carries the finished image after the dye transfer, can also be separated from the light-sensitive material, e.g. by using a stripping layer located between these two materials. An embodiment of this type is described for example in German Offenlegungsschrift No. 2,049,688.

Polymers which are suitable as mordants for the production of image-receiving layers are known from U.S. Pat. No. 3,709,690, which polymers are obtained by quaternising a polymer which contains tertiary nitrogen atoms with an alkylating agent or an aralkylating agent.

Water-insoluble polymers are described as mordants in German Offenlegungsschrift No. 2,445,782, which polymers are prepared by reacting polymers containing chloromethyl groups with tertiary amines, and which can be cross-linked according to the method described in U.S. Pat. No. 3,859,096. A disadvantage in using mordants of this type in color instant photography is the fact that there is a tendency for the mordanted image dyes to diffuse from the image areas into non-image areas. This diffusion of the dye which takes place because of the mordant not holding the dyes sufficiently firmly, leads to color fringing and, particularly during storage, to decreased color densities.

It is also known from German Offenlegungsschrift No. 2,551,786 to use water-insoluble polymers in the form of a dispersion for mordanting dyes. These latex mordants have the advantage that they can simply be mixed with the known binding agents into stable solutions, ready for casting. However, it is a disadvantage that the mordant layers prepared from the casting solutions do not bind the dyes sufficiently. Adequate color densities are indeed produced immediately after transferring the dyes into the mordant layer, but when the dyed mordant layers have been stored, there is a diffusion called a back-diffusion of the dyes from the mordant layer into the rest of the laminated structure, particularly where there is a multi-layered structure. This back-diffusion causes the color densities to be decreased during storage and thereby causes the image to become faded which is undesirable.

The object of the invention is to provide diffusion-resistant polymers which are suitable for use as mordants for the preparation of image-receiving layers, which polymers can retain the image dyes transferred onto the image-receiving layer so that the image dyes can no longer diffuse and dye images are obtained which have an increased density even during storage for extended periods of time.

It has been found that the polymeric mordants described as follows can be used advantageously and extensively where acidic dyes have to be mordanted. They are particularly suitable for use as mordants for image-receiving layers.

The object of the invention is a photographic material consisting of a layer support having coated thereon at least one image-receiving layer which contains a polymeric mordant for acidic dyes in which the polymeric mordant is a polymer, obtained by addition polymerization of a mixture of monomers containing at least 10 mole % of a monomer that on addition polymerization provides recurring structural units of the following formula I:

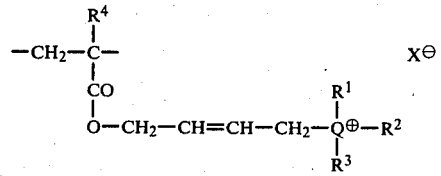

(I)

in which

Q represents a nitrogen or phosphorus atom;

$R^1$, $R^2$ and $R^3$ which may be the same or different represent a carbocyclic radical or an alkyl radical or two of these radicals may together complete a 5- or 6-membered heterocyclic ring, $R^4$ represents hydrogen or alkyl, and $X^{\ominus}$ represents an anion.

The recurring units of the above formula I are to be shown in the following description by the symbol A.

Alkyl radicals which in formula I are represented by $R^1$, $R^2$ and $R^3$ may be straight or branched chain alkyl radicals, and generally contain from 1 to 12 carbon atoms. Examples of these are methyl, ethyl, propyl, iso-butyl, pentyl, hexyl heptyl and dodecyl.

Where $R^1$, $R^2$ and/or $R^3$ in formula I represent carbocyclic radicals, these are preferably cycloalkyl, aralkyl or aryl radicals preferably having from 5 to 12 carbon atoms which may be substituted for example with halogen, nitro, cyano, alkyl, alkoxy, alkylthio and alkyloxy carbonyl, the alkyl portions in the last mentioned substituents having preferably 1 to 4 carbon atoms; examples of such unsubstituted or substituted cyclo alkyl, aralkyl and aryl groups are cyclopentyl, cyclohexyl, benzyl, p-methyl benzyl, chlorobenzyl, nitrobenzyl, cyanobenzyl, methoxybenzyl, methoxycarbonyl benzyl, ethylthiobenzyl, phenyl and tolyl.

Examples of 5- or 6-membered heterocyclic rings completed by two of the radicals $R^1$, $R^2$ and $R^3$ are the pyrrolidine ring, the piperidine ring and the morpholine ring. $R^1$ and $R^2$ most preferably represent methyl radicals and $R^3$ most preferably represents a benzyl radical.

$R^4$ preferably represents a methyl group.

$X^{\ominus}$ is any photographically inert anion, for example a halogen ion, e.g. bromide or chloride, or a sulfate, alkylsulfate, alkyl- or aryl-sulfonate, for example p-toluene sulfonate, acetate, phosphonate or dialkylphosphate ion.

The polymer used according to the invention preferably contains recurring units of the following formula II:

$$(-A-)_x(-M-)_y(-V-)_z \qquad \text{(II)}$$

in which A is defined as above and

M represents the residue of a polymerised monomer having a polymerisable ethylenically unsaturated radical;

V represents the residue of a polymerised monomer having at least two polymerisable ethylenically unsaturated radicals, e.g. vinyl radicals;

x,y,z represent the numbers of the individual comonomers in the polymer, so that x represents from 10 to 99 mol % y represents from 0 to 90 mol % and z represents from 0 to 5 mol %

Polymers which are particularly suitable for the production of the mordant layers are those of formula II, in which V is the radical of a monomer, polymerisable by addition polymerisation, having at least two ethylenically unsaturated radicals, e.g. vinyl radicals of the following formula III $$(CH_2{=}\overset{\overset{R^6}{|}}{C})_n{-}R^5 \qquad \text{(III)}$$

in which n represents an integer greater than 1, preferably 2, 3 or 4;

$R^5$ represents an n-valent organic radical; and $R^6$ represents a hydrogen atom or a methyl radical.

$R^5$ can represent for example a di- or polyvalent organic radical which is composed of alkylene groups, arylene groups, aralkylene groups, cycloalkylene groups, (or where it is a polyvalent organic radical, composed of the corresponding polyvalent analogues of the above-mentioned groups), also ester groups, sulfonyl ester groups, amide groups sulfonamide groups, ether oxygen atoms and thioether sulfur atoms, and combinations of the mentioned groups and atoms. $R^5$ can for example be a methylene; ethylene; trimethylene; phenylene; phenylenedioxycarbonyl; 4,4'-isopropylidene-bisphenyleneoxycarbonyl; methylene-oxycarbonyl; ethylenedioxycarbonyl; 1,2,3-propantri-yl-tris(oxycarbonyl)-; cyclohexylene-bis(methylene oxycarbonyl); ethylenebis-(oxyethylene oxycarbonyl); or ethylidyne-trioxycarbonyl group. Monomers which are stable in the presence of strong alkali and are not particularly reactive are preferably chosen, so that there is no hydrolysis during copolymerisation.

Examples of monomers, from which the units (V) can be formed, are the following: divinylbenzene, allyl acrylate; allyl methacrylate; N-allyl methacrylamide; 4,4'-isopropylidenediphenyl diacrylate; 1,3-butylene diacrylate; 1,3-butylene dimethacrylate; 1-4 cyclohexylene dimethylene dimethacrylate; di-ethylene glycol-dimethacrylate; diisopropylene glycol dimethacrylate; ethylene diacrylate; ethylene dimethacrylate; ethylidene diacrylate; 1,6-diacrylamidohexane; 1,6-hexamethylene diacrylate; 1,6-hexamethylene dimethacrylate; N,N'-methylene-bisacrylamide; neopentylglycol dimethacrylate; tetraethylene glycol dimethacrylate; tetramethylene diacrylate; tetramethylene dimethacrylate; 2,2,2-trichloroethylidene dimethacrylate; triethylene glycol diacrylate; triethylene glycol dimethacrylate; ethylidyne-trimethacrylate; 1,2,3-propanetriyltriacrylate; vinylmethacrylate; 1,2,4-trivinyl cyclohexane and tetraallyl oxyethane.

Monomers which are particularly advantageous for the production of units (V) are trivinyl cyclohexane, divinyl benzene, tetraallyl oxyethane and 1,4-butylene dimethacrylate. Two or more of the above-mentioned monomers may also be used at the same time for the production of units V of the polymers of the invention.

A wide variety of monoethylenically unsaturated monomers which are copolymerisable with the other monomers can be used for producing the units (M). Monomers having conjugated ethylenically unsaturated bonds can also be used.

The following are typical of suitable monomers; ethylene; propylene; 1-butene; 4-methylpentene-1; styrene; α-methylstyrene; monoethylenically unsaturated esters of aliphatic acids e.g. vinyl acetates; isopropenyl acetate, and allyl acetate, esters of ethylenically unsaturated mono- and dicarboxylic acids, e.g. methyl methacrylate; ethyl acrylate; glycidyl acrylate; glycidyl methacrylate and butyl acrylate, also other monoethylenically unsaturated compounds such as for example acrylonitrile; allyl cyanide; and other conjugated dienes, e.g. butadiene; isoprene and 2,3-di-methyl butadiene.

The units (V) are preferably present to an extent of from 1.0 to 5.0 mol %, the units (M) to an extent of from 0 to 45 mol % and the units having the ω-substituted butene-2-yl-(meth) acrylate radical (A) of the invention to an extent of from 40 to 99 mol %.

The polymers used according to the invention are produced by using conventional emulsion polymerisation processes, for example by the emulsion polymerisation of a 4-halo-butenyl methacrylate with a polyunsaturated monomer (V) and a mono-ethylenically unsaturated monomer (M), suitable in the presence of an anionic surface-active compound, for example sodium lauryl sulphate or in the presence of the sodium salt of a sulphonated condensate of an alkyl pheno-ethylene oxide condensate (e.g. Alipal, manufacturer: General Dyestuff Corp., U.S.A.) or the like and also suitably in the presence of a radical former or radical initiator, for example in the presence of a free radical forming initiator of the Redox type e.g. in the presence of potassium persulphate-sodium bisulphite; potassium persulphate-$Fe^{2+}$ or $H_2O_2$-$Fe^{2+}$. Processes can be used which are described for example in U.S. Pat. No. 3,072,588.

The polymeric 4-halo-butenyl methacrylate latex produced by this process can be reacted with a tertiary amine or a tertiary phosphine of the following formula:

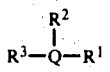

in which $R^1$, $R^2$, $R^3$ and Q are defined as stated above, the reaction preferably being carried out at temperatures of approximately −20° C. to approximately 150° C. A polymeric microgel-latex is produced.

The 4-halo-butenyl-(meth) acrylates required as the starting material are known, e.g. from U.S. Pat. No. 3,225,163. They can be obtained for example by transesterification of methyl-(meth)acrylate with 4halogen-2-butene-1-ol. Another process for preparing the mentioned monomers is described in German Offenlegungsschrift No. 28 27 323. The monomers obtained in this manner are either subjected immediately to polymerisation into poly-4-halo-butenyl-(meth) acrylate, which is then quaternised, or they are quaternised first of all and the monomeric quaternary salts obtained in this manner are then polymerised with the monomers (M) and (V) in the presence of a radical former. In the latter case, it is possible to use a surface-active compound in the polymerisation, but it is not essential, since the monomeric ammonium salt has surface-active properties. The polymer latex which results contains a sufficient number of cationic units necessary for the mordant effect without further reaction. It is also possible to polymerise the 4-chlorobutenyl monomers together with a monomeric quaternisation product which is produced therefrom and to quaternise the polymerised material with a tertiary amine or phosphine, which may be different from that which was used for quaternising the monomer, into a polymer used according to the invention.

In the preparation of the polymers in the described manner, some recurring units of the following formula can be formed by hydrolysis of the reactive halo-butenyl methacrylate radicals with the release of hydrogen chloride:

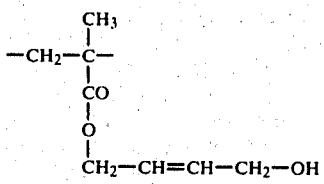

Also, cross-linking within a latex particle can occur as a result of the reaction between two reactive halo-butenyl methacrylate radicals in the presence of water, so that the effect of the polyfunctional monomer (V) is increased. In some cases, it may also be sufficient not to use a polyfunctional monomer (V) and to bring about the cross-linking of the latex particle exclusively through the reaction of the halo-butenyl groups. The polymers used according to the invention preferably consist however of, at the most, up to 5 mol % of recurring units, which have been produced in the manner stated by modifying the halo-butenyl radical.

The polymers which are used according to the invention and can be dispersed in water can have a particle size of from 20 to 500 nm; usually they have a particle size of approximately 50 nm to approximately 200 nm, preferably a particle size of from 60 to 100 nm.

The polymers used according to the invention can be produced relatively easily, since they can be prepared in one vessel. It is not necessary to use large quantities of solvents. The polymers which can be prepared in the manner described are typically not completely quaternised. The level of quaternisation is generally from approximately 80 to approximately 100 mol %.

Polymers which can be used according to the invention can thus be built up for example from:

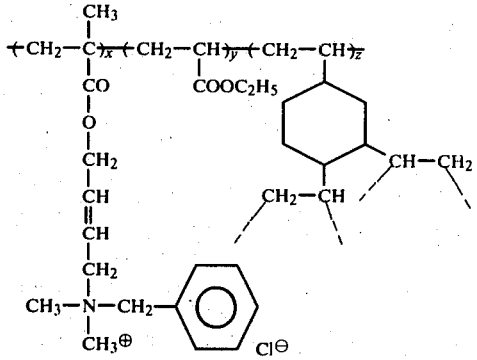

(1.)

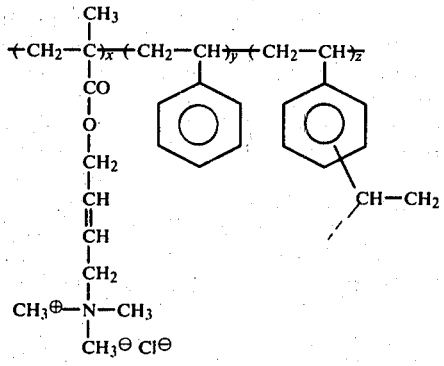

(2.)

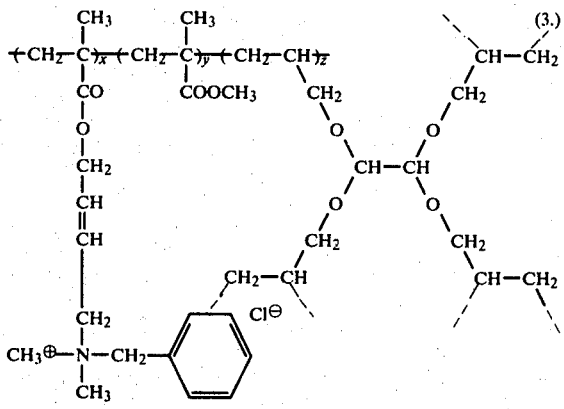

(3.)

-continued

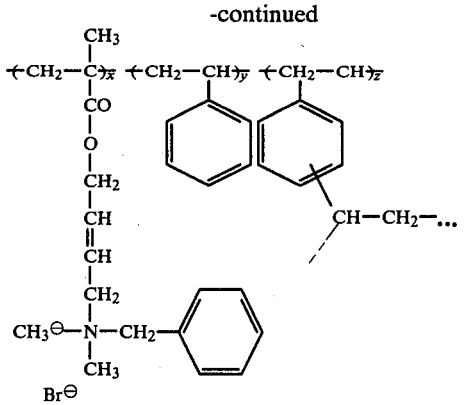

(4.)

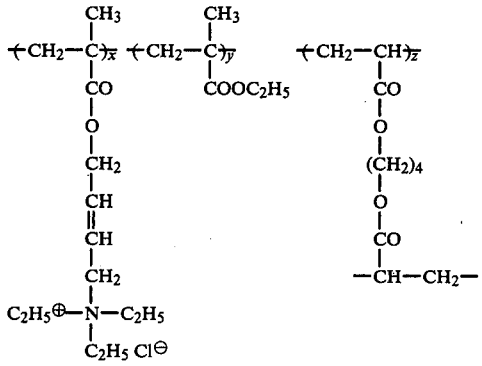

(5.)

The polymers prepared according to the method described are generally adequately pure and contain only insignificant quantities of impurities. However, in some cases, it may be necessary to purify the polymer dispersions. For this purpose, the processes of dialysis or ultrafiltration, which are known to the skilled worker are suitable. Mixed bed ion exchangers can also be used successfully to remove ionic impurities, which ion exchangers make is possible for the polymers to be completely freed from salts. The polymer dispersions of the invention can be purified in a particularly effective manner by means of a flocculation/re-dispersion process. By acidifying the dispersion, the polymer can be flocculated and separated as solid matter and can be washed with diluted acids and solvents. The subsequent redispersion of the polymer is for example effected simply by stirring in water, in the neutral to slightly alkaline pH-range.

The purification process which has been described also makes it possible to dry the polymer after the flocculation and washing process and after isolating and storing it in the form of a powdered solid. By this method, bacterial attack which is frequently observed when aqueous dispersions are stored can be avoided.

In order to produce the image-receiving layers of the invention, the polymers which are obtained are usually cast as a latex, so that they are used in the form in which they have been produced by the preparation process or optionally from a purification operation which took place after preparation, or also in the form of a redispersion, if there was a previous drying process. Redispersion in aqueous medium can be carried out in a remarkably simple manner, which is presumably due to the large number of polar groups in the polymer. Other substances can optionally be mixed with the polymers of the invention in the production of image-receiving layers, particularly hydrophilic colloidal binding agents. These include the conventional known hydrophilic colloids, which are generally used in the production of photographic layers, for example gelatine, colloidal albumin, polysaccharides, cellulose derivatives, synthetic resins, e.g. polyvinyl compounds, for example polyvinyl alcohol and derivatives of polyvinyl alcohol, acrylic amide polymers, and polyurethanes.

The polymers used according to the invention are used in conventional concentrations, so that the optimum quantity of mordant in an individual case depends on the type and quantity of the dye which is to be mordanted, on the mordant itself and also on the manner in which the production of the image takes place. The concentration of mordant which is necessary or favourable in an individual case can easily be determinated. The amount of mordant in the image-receiving layer suitably amounts to at least 10% by weight, based on the total solids content and preferably up to 50% by weight or more.

A wide variety of known conventional additives can be incorporated into the mordant layer, for example ultra-violet absorbers, e.g. substituted 2-hydroxyphenyl-benzo triazoles, (Tinuvin) and hydroxy benzophenones and also antioxidation agents, e.g. tertiary butylhydroxy anisole, butylated hydroxytoluene, and substituted chromanoles. As these additives are in general substances which are soluble in organic solvents, they are suitably used in the form of an emulsion in an aqueous medium.

The mordants used according to the invention can be used for the preparation of a wide variety of photographic materials, which comprise a mordant layer, in the use of which acidic dyes are to be mordanted.

One or more of the mordants used according to the invention can also be used, namely in one layer or in two or more different layers of a photographic material. Also, the mordants used according to the invention can be used together with other known mordants in the same layer or in different layers of the same material.

According to the present invention, the polymers described are mainly used as a mordant for the diffusing image dyes, e.g. they are a substantial constituent of the image-receiving layers for the transfer process of color diffusion. Image-receiving layers of this type are usually coated on a transparent or an opaque substrate and together with the substrate form the image-receiving material. This is either not sensitive to light as a separate image-receiving layer, or it can form an integral component of a light-sensitive recording material, when the image-receiving layer is in close contact with one or more light-sensitive silver halide emulsion layers.

Suitable substrates are for example paper, which may be coated with a synthetic material, glass, metal films or films made of organic film formers of the materials such as cellulose esters, polyethylene terephthalate, polycarbonate or other polymers. As a result of introducing opacifying agents such as pigments, opaque substrates can also be produced from the last-mentioned materials.

The photographic material of the invention is composed, in the simplest arrangement, of a layer support and an image-receiving layer which is coated thereon, and which contains recurring structural units of formula I, optionally together with a colloidal binding agent. In order to improve the adhesion of the image-receiving layer to the substrate, the latter can be provided with a conventional adhesive layer. A material of this type is suitable as an image-receiving material for any kind of photographic color diffusion transfer process, in which acidic, diffusible image dyes or also acidic, diffusible color formers (image dye precursors) are used or released imagewise and can be transferred onto an image-receiving layer. When the transfer has been completed, accordingly a material of this type exhibits an image-wise distribution of one or more acidic dyes in the image-receiving layer.

According to an advantageous embodiment of the invention, the photographic material comprises an image-receiving layer containing the polymers of the invention and additionally at least one layer having in uniform distribution an acidic dye or a precursor compound for an acidic dye, and at least one light-sensitive layer, particularly a light-sensitive silver halide emulsion layer. The acidic dyes which have been mentioned or precursor compounds for acidic dyes are described, taking them together, in the following as color-providing compounds. The photographic material of the invention can advantageously also contain several light-sensitive silver halide emulsion layers having different spectral sensitivities and also other non-light-sensitive layers such as intermediate layers, protective layers and other layers having a wide variety of functions, as is customary in multilayered colour photographic recording materials.

The photographic materials of the invention, e.g. the image-receiving materials and particularly the color photographic recording materials, which contain as an integral component an image-receiving material of this type, can also contain acidic layers, and so-called retarding or delaying layers, which together form a so-called neutralisation system. A neutralisation system of this type can be located between the substrate and the image-receiving layer positioned thereon, in known manner, or in another position in the laminated structure, e.g. above the light-sensitive layers, i.e. on the other side of these light-sensitive layers seen from the image-receiving layer.

The neutralisation system is normally orientated so that the retarding or delaying layer lies between the acidic layer and the place in which the alkaline developing liquid or developing paste is applied for its effect. Such acidic layers, retarding layers or neutralisation layers consisting of both of these are known for example from U.S. Pat. Nos. 2,584,030; 2,983,606; 3,362,819 and 3,362,821 and German Offenlegungsschriften Nos. 2,455,762; 2,601,653; 2,716,505; 2,601,653; 2,716,505 and 2,816,878. A neutralisation system of this type can also contain in known manner two or more retarding layers.

The photographic material of the invention in a particular embodiment can contain one or more opaque layers which contain a pigment and are permeable to aqueous liquids. The opaque layers can perform two functions. Firstly, the undesired access of light to light-sensitive layers can be prevented and secondly, a pigment layer of this type can form an aesthetically pleasing background for the color image which has been produced, particularly when a light or white pigment e.g. $TiO_2$ is used. Integral color photographic recording materials comprising a pigment layer of this type are known e.g. from U.S. Pat. No. 2,543,181 and from German Auslegeschrift No. 1,924,430. Instead of a preformed opaque layer, means can also be provided to produce such a layer during the development process. According to both of the functions mentioned, pigment layers of this type can be constructed of two or more partial layers, one of which contains for example a white pigment and the other contains for example a dark, light-absorbing pigment, e.g. carbon black.

In a particularly preferred embodiment of the invention, the photographic material is an integral color photographic recording material for carrying out the color diffusion transfer process and comprises for example the following layer elements:

(1) a transparent substrate,
(2) an image-receiving layer,
(3) a layer impervious to light (pigment layer)
(4) a light-sensitive element comprising at least one light-sensitive silver halide emulsion layer and at least one color-providing compound associated therewith,
(5) a retarding layer,
(6) an acidic polymer layer,
(7) a transparent substrate.

This material can thereby be composed so that two different parts are prepared separate from each other, namely the light-sensitive part (layer elements 1–4) and the covering part (layer elements 5–7), which are then positioned on top of each other on the emulsion side and are joined together, optionally using spacing strips, so that a gap is formed between both parts for receiving an exactly measured quantity of a developer liquid. The layer elements 5 and 6, which together form the neutralisation system, can also be positioned, that is in reverse order, between the substrate and the image-receiving layer of the light-sensitive part.

Means can be provided to introduce a developer liquid between two adjacent layers of the integral recording material, e.g. in the form of a vessel which can be ruptured and is positioned sideways, and which pours out its contents between two adjacent layers of the recording material, in the present case between the light-sensitive part and the covering part, as a result of the effect of mechanical forces.

The light-sensitive element which, in the case of an integral recording material, is an essential constituent of the photographic material of the invention, or, if the photographic material of the invention is itself not light-sensitive, but only substantially consists of a substrate and an image-receiving layer, must be brought into contact with the latter during the developing process, contains, in the case of a single dye transfer process, a light-sensitive silver halide emulsion layer and a color-providing compound associated therewith. The color-providing compound can be situated in a layer adjacent to the silver halide emulsion layer or in the silver halide emulsion layer itself; in the latter case, the color of the image dye is preferably selected so that the predominant absorption region of the color-providing compound does not correspond to the predominant sensitivity region of the silver halide emulsion layer. In order to produce multi-colored transfer images in life-like colors, the light-sensitive element however contains three such units of a color-providing compound and an associated light-sensitive silver halide emulsion layer, and the absorption region of the image dye resulting from the color-providing compound will usually substantially correspond to the spectral sensitivity region of the associated silver halide emulsion layer. However, it is preferred in order to obtain as high a sensitivity as possible, if the color-providing compound is positioned in a separate binding agent layer (seen in the direction of the light during exposure) behind the silver halide emulsion layer or if it has an absorption which is different from that of the image dye ("shifted image dyes"—U.S. Pat. No. 3,854,945).

The developer oxidation products produced when a silver halide emulsion layer is developed, should naturally only have an effect on the associated color-providing compound. Therefore, separating layers are generally present in the light-sensitive element, which effectively prevent the developer oxidation products from diffusing into other, non-adjacent layers. These separating layers can for example contain suitable substances which react with the developer oxidation products, for example non-diffusing hydroquinone derivatives or, if the developer compound is a color developer compound, non-diffusing color couplers.

The color-providing compounds can be colored compounds, which are themselves capable of diffusion and which, upon processing the layers with an alkaline, processing liquid, start to diffuse and are only fixed in the exposed areas as a result of the development process. The color-providing compounds, can however also be diffusion resistant and can release a diffusible dye during development.

Color-providing compounds which are, a priori diffusible, are known for example from German Pat. Nos. 1,036,640; 1,111,936 and 1,196,075. The so-called dye developers which are described therein contain a dye radical and a group in the same molecule, which group is able to develop exposed silver halide.

Among the processes which have become known up to the present time for producing color photographic images according to the color diffusion transfer process, those processes which are based on using, color-providing compounds which are incorporated in the layers in diffusion-fast manner, from which diffusible dyes or dye precursor products are released imagewise during development and are transferred onto an image-receiving layer have recently become increasingly important. Non-diffusible color-providing compounds of this type are described for example in the following publications:

U.S. Pat. Nos. 3,227,550; 3,443,939 and 3,443,940 German Offenlegungsschriften Nos. 1,930,215; 2,242,762; 2,402,900; 2,406,664; 2,505,248; 2,543,902; 2,613,005; 2,645,656 and 2,809,716 and Belgian Pat. No. 861,241.

In the publications mentioned, non-diffusible color-providing compounds which produce negative color images when using conventional negative silver halide emulsions are described, and also those which produce positive color images when using negative silver halide emulsions. In the first case, if positive color images are required, it is either necessary directly to use positive silver halide emulsions or, when using negative emulsions, to use one of the known reversal processes, e.g. the silver salt diffusion process (U.S. Pat. No. 2,763,800) for by using compounds which release development inhibitors as a result of development.

EXAMPLE 1

Preparation of Polymer A 400 ml of water and 5 g of the surfactant Triton 770 (30%)—(commercial product of Röhm and Haas) were heated to 60° C. and degassed with nitrogen gas.

6 g of a mixture of 38.5 g of 4-chloro-2-butenyl methacrylate (monomer 1), 22.1 g of ethylacrylate (monomer 2) and 1.45 g of 1,2,4-trivinyl-cyclohexane (monomer 3) were added with stirring. After stirring for 10 minutes at 60° C., 0.6 g of potassium persulfate and 0.6 g of sodium metabisulfite were added, the rest of the monomer mixture was dropped in for 30 minutes and this was stirred for a further 2 hours. The latex which was obtained (polymer A) had a solids content of 12% and was free from sedimented particles. The polymers B,C,D,E and F were also prepared in a similar manner with the monomers 1,2, and 3 being varied in type or quantity as can be seen from the following Table.

Preparation of Polymer 1

200 g of polymer A having a solids content of 12% were mixed with 40 ml of isopropanol and a solution of 10.7 g of N,N-dimethylbenzyl-amine in 20 ml of isopropanol for 15 minutes and stirred for 6 hours at 60° C. The latex which was obtained was filtered through a filter paper and had a solids content of 8.5%. Polymers 2 to 15 were also prepared in a similar manner as latices from the polymers A to F and from corresponding amines as can be seen from the following Table 2.

TABLE 1

| Polymer | Monomer 1 | Mol-% | Monomer 2 | Mol-% | Monomer 3 | Mol-% |
|---|---|---|---|---|---|---|
| A | 4-chlorobutenyl-methacrylate | 49 | Ethyl-acrylate | 49 | Trivinyl-cyclohexane | 2 |
| B | 4-chlorobutenyl-methacrylate | 49 | Glycidylmeth-acrylate | 49 | Butanedioldi-acrylate | 2 |
| C | 4-chlorobutenyl-methacrylate | 49 | Styrene | 49 | Divinylbenzene | 2 |
| D | 4-chlorobutenyl-methacrylate | 60 | Methyl-methacrylate | 38 | Tetraallyl-oxyethane | 2 |
| E | 4-chlorobutenyl-methacrylate | 48 | Butyl-acrylate | 48 | Ethanediol-dimethacrylate | 4 |
| F | 4-chlorobutenyl-methacrylate | 50 | Ethyl-acrylate | 50 | — | — |

TABLE 2

| Polymer | Polymer | Amine | Degree of Quaternisation [Mol % based on Cl] |
|---|---|---|---|
| 1 | A | N,N—Dimethylbenzylamine | 93 |
| 2 | A | Trimethylamine | 93 |
| 3 | A | Triethylamine | 90 |
| 4 | B | N,N—Dimethylbenzylamine | 92 |
| 5 | B | Triethylamine | 92 |
| 6 | C | N,N—dimethylbenzylamine | 90 |
| 7 | C | Trimethylamine | 90 |
| 8 | C | Tri-n-propylamine | 90 |
| 9 | D | N,N—dimethylbenzylamine | 88 |
| 10 | D | Trimethylamine | 92 |
| 11 | D | Triethylamine | 92 |
| 12 | E | Trimethylamine | 90 |
| 13 | F | Trimethylamine | 93 |
| 14 | F | N,N—Dimethylbenzylamine | 93 |
| 15 | F | N,N—Dimethyl-4-chlorobenzylamine | 90 |

EXAMPLE 2

An integral color photographic recording material was prepared with the following layers being applied successively to a transparent polyester film substrate. The quantities specified refer the amounts applied to 1 square meter. Attention is directed to the formulae appendix for the formulae of the compounds L,M,N,O,P and Q.

1. A mordant layer of 2.7 g of a mixed polymer consisting of styrene, N,N,N-trimethyl-N-(4-vinylbenzyl-) ammonium chloride and divinylbenzene according to Example 2 of German Offenlegungsschrift No. 2,551,786, and 2.7 g of gelatine.

2. A reflection layer containing 18 g of $TiO_2$ and 2.6 g of gelatine.

3. A carbon black covering layer containing 1.87 g of carbon black and 2.0 g of gelatine.

4. A cyan dye releasing layer consisting of 0.53 g of compound L and 1.06 g of gelatine.

5. A red-sensitive direct positive working emulsion layer containing 1.46 g of silver, 0.23 g of 2-octadecyl-hydroquinone sulphonic acid-5, 1.9 g of gelatine and 0.028 mg of compound 0 (fogging agent).

6. A barrier layer containing 0.4 g of 2-acetyl-5-octadecyl-hydroquinone and 1 g of gelatine.

7. A magenta dye releasing layer consisting of 0.89 g of compound M and 1.1 g of gelatine.

8. A green-sensitive direct positive working emulsion layer containing 1.33 g of silver, 0.21 g of 2-octadecyl hydroquinone sulphonic acid-5, 1.75 g of gelatine, 0.07 mg of compound 0 and 1.96 mg of compound P (fogging agent).

9. A barrier layer consisting of 0.8 g of 2-acetyl-5-octadecyl-hydroquinone and 1 g of gelatine.

10. A yellow dye releasing layer consisting of 0.85 g of compound N and 1.28 g of gelatine.

11. A blue-sensitive direct positive working emulsion layer consisting of 1.27 g of silver, 0.2 g of octadecylhydroquinone sulphonic acid-5, 1.67 g of gelatine and 0.04 mg of compound 0.

12. A protective layer containing 0.04 g of 2-acetyl-5-octadecylhydroquinone and 1.0 g of gelatine.

13. A hardening layer containing 0.3 g of compound Q and 0.3 g of gelatine.

A neutralisation layer and time controlling layers were applied to a second transparent substrate.

Both layers were joined into a set on the side of the emulsion and were bonded at the edges. After exposure through the second substrate, a developer paste was distributed between both films in an amount of 100 μm, which was determined by spacing strips between the layers.

The paste had the following composition:

| | |
|---|---|
| 1.5 ml | Benzyl alcohol |
| 6 g | 4-hydroxymethyl-4-methyl-1-phenyl-3-pyrazolidone |
| 0.2 g | Hydroquinone |
| 70 g | KOH |
| 1 g | $Na_2SO_3$ |
| 3 g | Methyl benzotriazole |
| 155 g | Carbon black |
| 34 g | Natrosol HHR 250 |
| 762 g | Water |

Integral recording materials 1–15 of the invention were prepared in a similar manner and were processed, the polymers 1–15 of the invention being used in the mordant layer instead of the known mordants.

The color densities which were measured under blue-(B), green-(G) or red filters (R), were measured after one hour of contact time and are summarised in Table 3. Table 4 contains examples of improved image stability during the drying phase in respect of back-diffusion, particularly of the yellow dyes.

TABLE 3

| | | Material | | | | | | | | | | | | | | |
|---|---|---|---|---|---|---|---|---|---|---|---|---|---|---|---|---|
| | (Comparison) | 1 | 2 | 3 | 4 | 5 | 6 | 7 | 8 | 9 | 10 | 11 | 12 | 13 | 14 | 15 |
| B | 0,35 | 0,37 | 0,36 | 0,35 | 0,35 | 0,33 | 0,36 | 0,35 | 0,36 | 0,34 | 0,36 | 0,35 | 0,36 | 0,37 | 0,35 | 0,36 |
| G | 0,29 | 0,30 | 0,31 | 0,29 | 0,31 | 0,29 | 0,31 | 0,29 | 0,30 | 0,31 | 0,30 | 0,30 | 0,29 | 0,30 | 0,30 | 0,29 |
| R | 0,29 | 0,29 | 0,29 | 0,28 | 0,30 | 0,30 | 0,29 | 0,29 | 0,29 | 0,29 | 0,29 | 0,29 | 0,29 | 0,30 | 0,29 | 0,30 |
| B | 2,08 | 2,25 | 2,16 | 2,05 | 1,98 | 2,13 | 2,17 | 2,18 | 2,04 | 2,21 | 1,98 | 1,99 | 1,95 | 2,01 | 2,12 | 2,08 |
| G | 1,90 | 2,00 | 2,17 | 1,95 | 1,91 | 1,96 | 1,95 | 2,05 | 1,94 | 2,00 | 1,93 | 1,96 | 1,90 | 1,95 | 1,90 | 2,02 |
| R | 1,75 | 1,82 | 1,96 | 1,78 | 1,79 | 1,82 | 1,82 | 1,89 | 1,79 | 1,81 | 1,80 | 1,83 | 1,78 | 1,83 | 1,84 | 1,86 |

TABLE 4

| | | (Comparison) | 1 | 6 | 9 |
|---|---|---|---|---|---|
| fresh | | | | | |
| | B | 2,08 | 2,25 | 2,17 | 2,21 |
| D max | G | 1,90 | 2,00 | 1,95 | 2,00 |
| | R | 1,75 | 1,82 | 1,82 | 1,81 |
| After 21 days | | | | | |
| | B | 1,56 | 1,98 | 2,15 | 2,03 |
| D max | G | 1,70 | 1,88 | 1,96 | 1,91 |
| | R | 1,75 | 1,83 | 1,86 | 1,85 |

Formula Appendix to Example 2

L

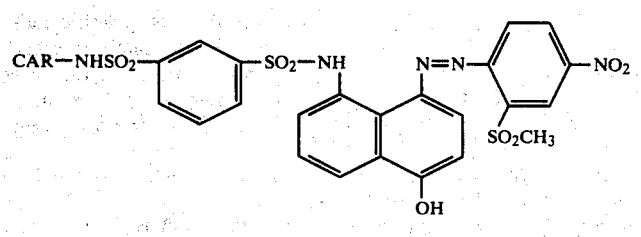

-continued

Formula Appendix to Example 2

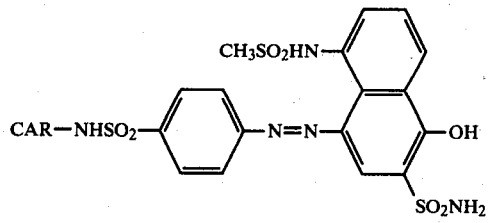

M

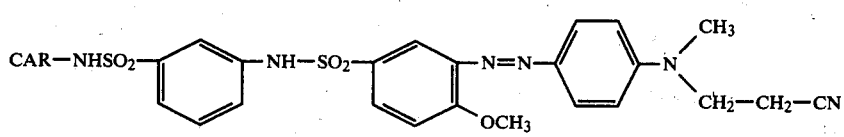

N

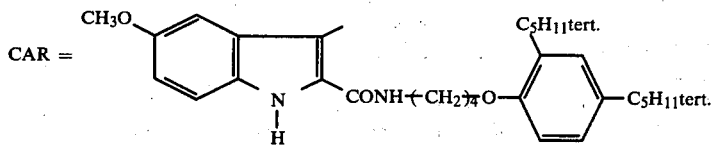

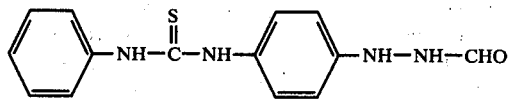

O

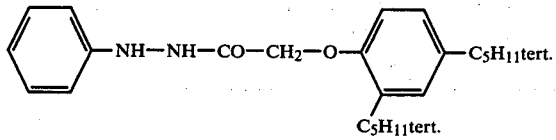

P

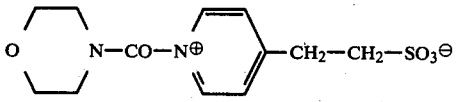

Q

We claim:

1. A photographic material comprising a layer support having coated thereon at least one image-receiving layer which contains a polymeric mordant for acidic dyes, in which the polymeric mordant is a polymer obtained by addition polymerisation of a mixture of monomers containing at least 10 mole % of a monomer that on addition polymerisation provides recurring structural units of formula I

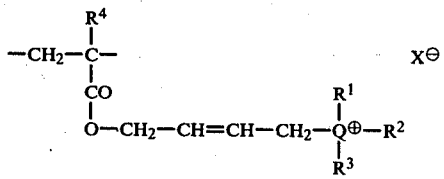

(I)

in which

Q is a nitrogen or phosphorus atom;

$R^1$, $R^2$ and $R^3$ are the same or different and represent alkyl radicals of 1 to 12 carbon atoms or carbocyclic radicals selected from the group consisting of cycloalkyl, aralkyl and aryl radicals or two of the substituents $R^1$, $R^2$ and $R^3$ together with the Q complete a 5- or 6-membered heterocyclic ring.

$R^4$ represents hydrogen or methyl $X^{\ominus}$ represents an anion.

2. A photographic material as claimed in claim 1 in which $R^1$, $R^2$ and $R^3$ are the same or different and represent methyl, ethyl or benzyl.

3. A photographic material as claimed in claim 1 in which the image-receiving layer which contains the polymeric mordant contains also mordanted therein one or more acidic dyes in image distribution.

4. A photographic material as claimed in claim 1 having in contact with the image-receiving layer a light sensitive recording element comprising at least one light sensitive silver halide emulsion layer and associated thereto in uniform distribution a color-providing compound.

5. A photographic material comprising a layer support and at least one image-receiving layer containing as a polymeric mordant for acid dyes obtained by addition polymerisation of a mixture of monomers and corresponding to the following formula $$(—A—)_x\,(—M—)_y\,(—V—)_z$$

in which A is

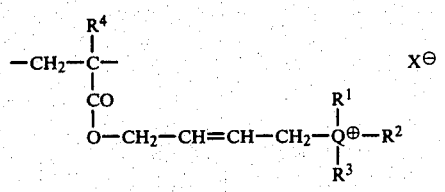

(I)

in which $Q_1$ is a nitrogen or phosphorus atom;

$R^1$, $R^2$ and $R^3$ are the same or different and represent alkyl radicals of 1 to 12 carbon atoms or carbocyclic radicals selected from the group consisting of cycloalkyl, aralkyl and aryl radicals or two of the substituents $R^1$, $R^2$ and $R^3$ together represent a group necessary for completing a 5- or 6-membered heterocyclic ring selected from the group consisting of pyrrolidine, piperidine and morpholine rings;

$R^4$ represents hydrogen or methyl:

V represents the residue of a polymerised monomer containing at least two polymerisable ethylenically unsaturated groups;

M represents the residue of a polymerised monomer containing one polymerisable ethylenically unsaturated group;

x, y and z represent the figures indicating the proportions of the monomers in the polymer, such that x stands for 10 to 99 mole % y stands for 0 to 90 mole % z stands for 0 to 5 mole %;

$X^-$ represents an anion.

6. A photographic material as claimed in claim 5 in which the mordant is a polymer obtained by addition polymerisation and in which V is the radical of a monomer, polymerisable by addition polymerisation, having at least two ethylenically unsaturated radicals of the following formula III

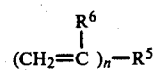

(III)

in which n represents an integer greater than 1, preferably 2, 3 or 4:

$R^5$ represents a di- or polyvalent organic radical which is composed of alkylene groups, arylene groups, aralkylene groups, cycloalkylene groups, a polyvalent organic radical, composed of the corresponding polyvalent analogues thereof, ester groups, sulfonyl ester groups, amide groups, sulfonamide groups, ether oxygen atoms and thioether sulfur atoms, and $R^6$ represents a hydrogen atom or a methyl radical.

* * * * *